US011684899B2

(12) United States Patent
Benson

(10) Patent No.: US 11,684,899 B2
(45) Date of Patent: Jun. 27, 2023

(54) COOLER WITH POWERED MIXER

(71) Applicant: Nicko L. Benson, Fort Wayne, IN (US)

(72) Inventor: Nicko L. Benson, Fort Wayne, IN (US)

( * ) Notice: Subject to any disclaimer, the term of this patent is extended or adjusted under 35 U.S.C. 154(b) by 425 days.

(21) Appl. No.: 16/423,363

(22) Filed: May 28, 2019

(65) Prior Publication Data

US 2019/0358597 A1 Nov. 28, 2019

Related U.S. Application Data

(60) Provisional application No. 62/676,384, filed on May 25, 2018.

(51) Int. Cl.

| | |
|---|---|
| ***B01F 3/12*** | (2006.01) |
| ***B65D 81/38*** | (2006.01) |
| ***B65D 43/02*** | (2006.01) |
| ***B01F 15/00*** | (2006.01) |
| ***B01F 7/00*** | (2006.01) |
| ***B01F 15/06*** | (2006.01) |
| ***G08B 5/36*** | (2006.01) |
| ***H04R 1/02*** | (2006.01) |
| ***B01F 23/53*** | (2022.01) |
| ***B01F 27/112*** | (2022.01) |
| ***B01F 35/93*** | (2022.01) |
| ***B01F 35/32*** | (2022.01) |
| *B01F 35/90* | (2022.01) |
| *B01F 101/14* | (2022.01) |

(52) U.S. Cl.

CPC ..... *B01F 23/53* (2022.01); *B01F 27/112* (2022.01); *B01F 35/32025* (2022.01); *B01F 35/93* (2022.01); *B65D 43/0225* (2013.01); *B65D 81/3813* (2013.01); *G08B 5/36* (2013.01); *H04R 1/028* (2013.01); *B01F 2035/98* (2022.01); *B01F 2101/14* (2022.01); *B65D 2203/12* (2013.01); *H04R 2420/07* (2013.01)

(58) Field of Classification Search

CPC . F25D 23/12; F25D 2700/06; B65D 81/3813; A23G 9/04; B01F 25/54

See application file for complete search history.

(56) References Cited

U.S. PATENT DOCUMENTS

| | | | | |
|---|---|---|---|---|
| 6,959,562 | B2 * | 11/2005 | Navedo | A23G 9/045 366/251 |
| 8,638,224 | B2 * | 1/2014 | Park | F25D 29/00 340/540 |
| 10,345,026 | B2 * | 7/2019 | Fire | B67D 1/0844 |
| 10,876,780 | B1 * | 12/2020 | Tarantino | F25D 31/007 |
| 2016/0187046 | A1 * | 6/2016 | Chen | A45C 11/20 62/239 |
| 2019/0128589 | A1 * | 5/2019 | Adams | F25D 17/06 |

* cited by examiner

*Primary Examiner* — Elizabeth Insler

(74) *Attorney, Agent, or Firm* — Dunlap Bennett & Ludwig, PLLC

(57) ABSTRACT

A cooler includes a body made of an insulating material. The body includes a base and a sidewall upstanding from the base. The sidewall includes an upper rim defining an opening into the body. A lid releasably couples to the upper rim of the sidewall and covers the opening. A battery is coupled to the body. A mixer is coupled to an inner surface of the body and includes a motor electrically coupled to the battery. The mixer is configured to circulate water within the body when the motor is powered by the battery.

9 Claims, 4 Drawing Sheets

COOLER WITH POWERED MIXER

CROSS-REFERENCE TO RELATED APPLICATION

This application claims the benefit of priority of U.S. provisional application No. 62/676,384, filed May 25, 2018, the contents of which are herein incorporated by reference.

BACKGROUND OF THE INVENTION

The present invention relates to coolers and, more particularly, to a cooler with a powered mixer.

A cooler is an insulated container used to keep food or drink cool. Ice cubes are most commonly placed in it to help the contents inside stay cool. Ice packs are sometimes used, as they either contain the melting water inside, or have a gel sealed inside that stays cold longer than plain ice (absorbing heat as it changes phase).

Coolers are often taken on picnics, on vacation, or to sporting events. They are usually made with interior and exterior shells of plastic, with a hard foam in between. They come in sizes from small personal ones to large family ones with wheels. Coolers used at sporting events typically include a cylinder-shaped sidewall for containing liquids, and a spigot for dispensing liquids. Large quantities of sports drinks are made by adding powder into water within the cooler and then mixing the powder and water with a large spoon.

As can be seen, there is a need for a cooler within an internal powered mixer to mix water with a sports drink powder.

SUMMARY OF THE INVENTION

In one aspect of the present invention, a cooler comprises: a body made of an insulating material and comprising a base and a sidewall upstanding from the base, wherein the sidewall comprises an upper rim defining an opening into the body; a lid releasably coupled to the upper rim of the sidewall and covering the opening; a battery; and a mixer coupled to an inner surface of the body and comprising a motor electrically coupled to the battery, wherein the mixer is configured to circulate water within the body when the motor is powered by the battery.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
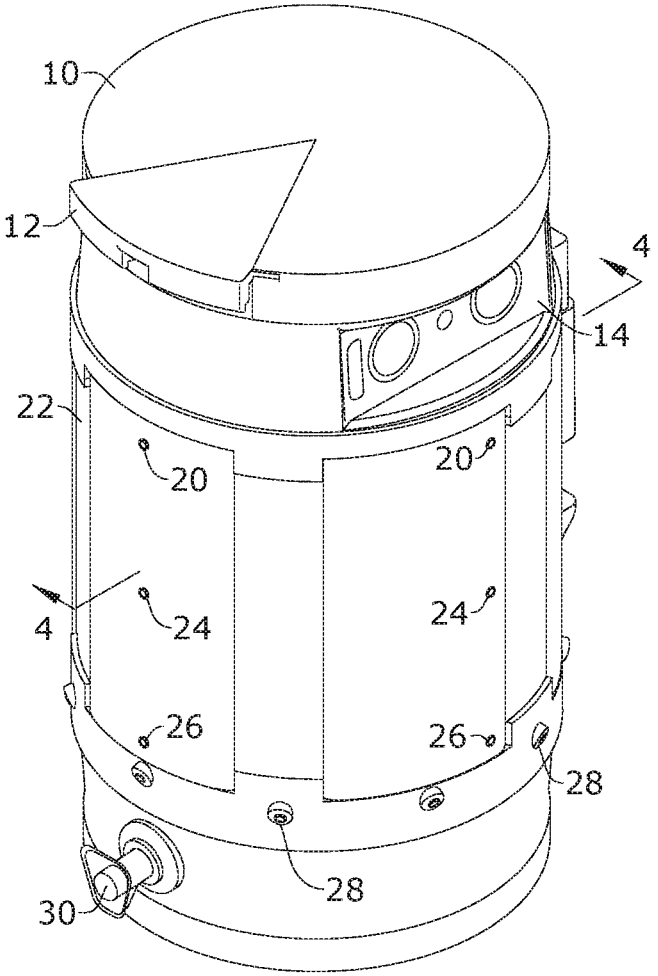
FIG. 1 is a perspective view of an embodiment of the present invention.
Figure 2:
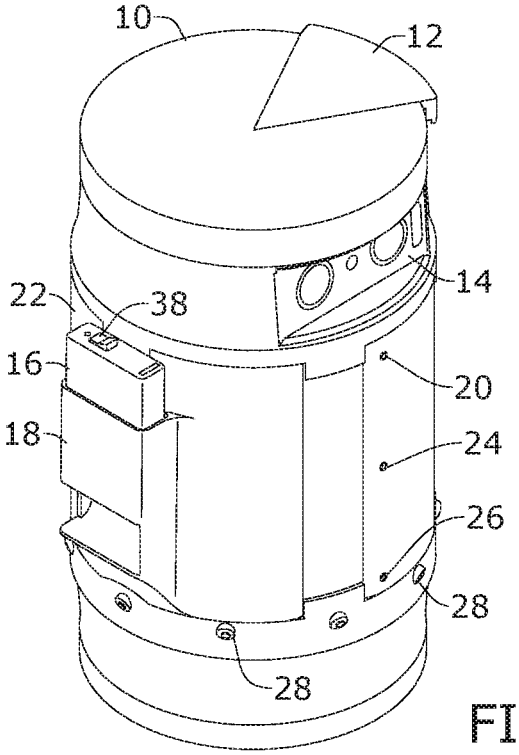
FIG. 2 is a rear perspective view of an embodiment of the present invention.
Figure 3:
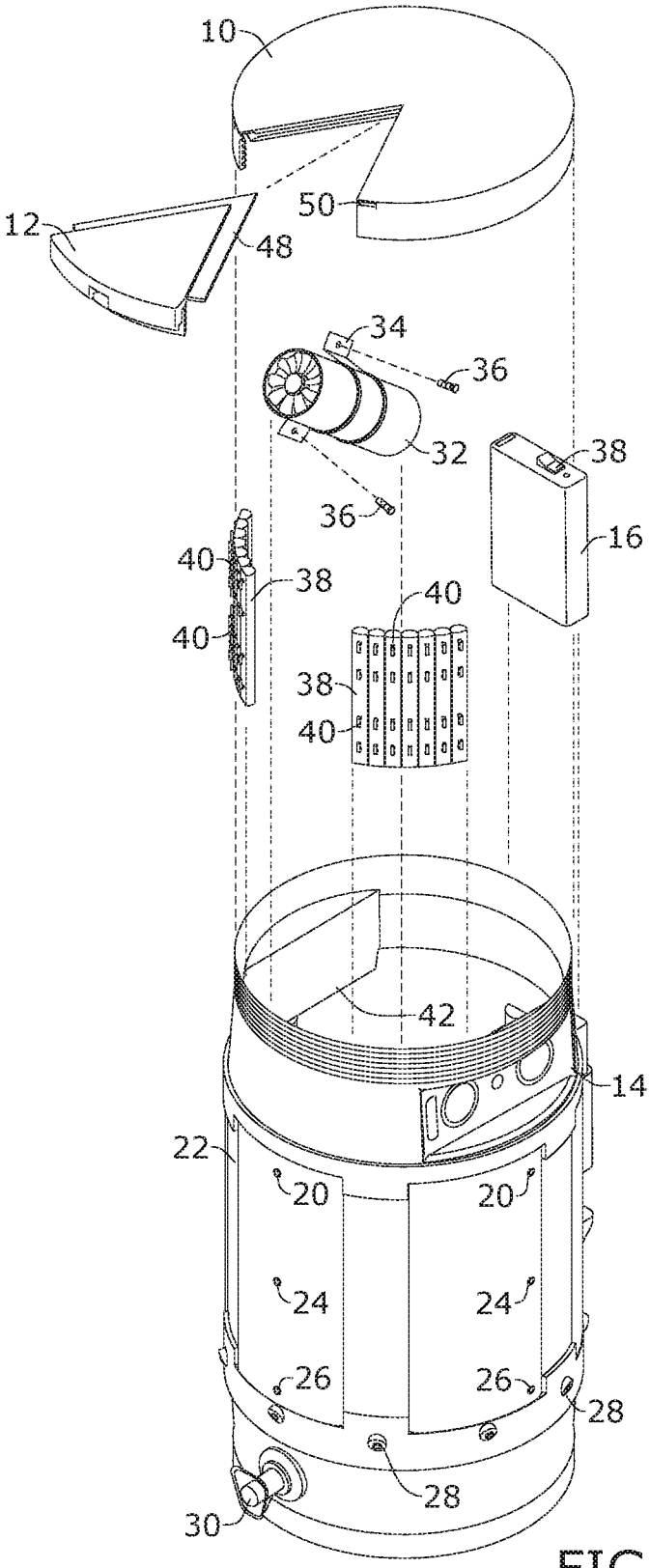
FIG. 3 is an exploded view of an embodiment of the present invention.
Figure 4:
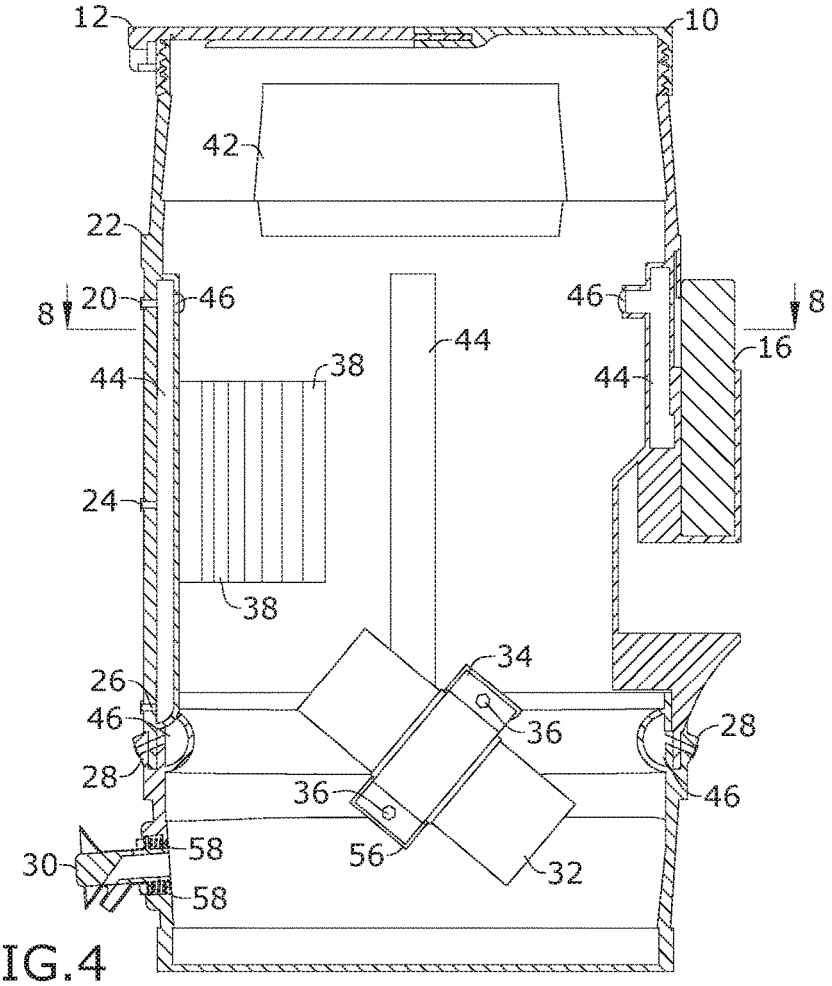
FIG. 4 is a section view of an embodiment of the present invention, taken along line 4-4 in FIG. 1.
Figure 5:
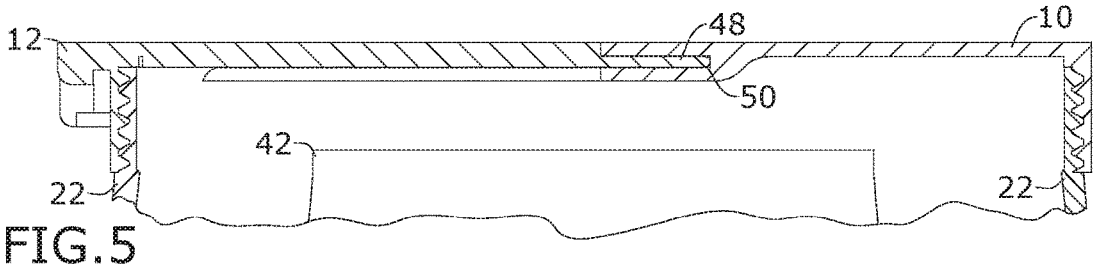
FIG. 5 is a detailed section view of a lid in a closed position.
Figure 6:
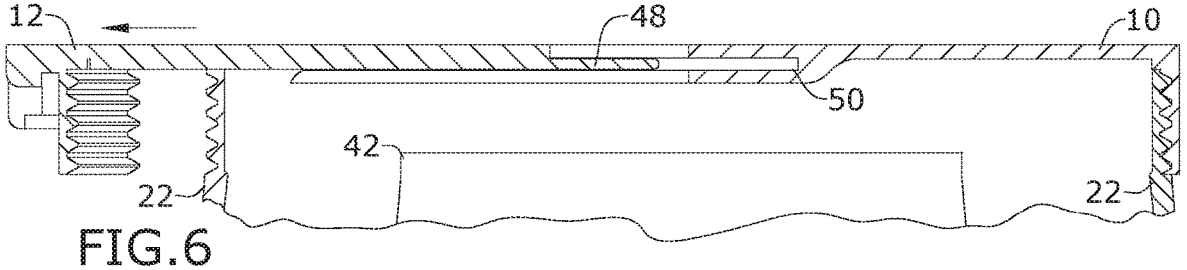
FIG. 6 is a detailed section view of a lid in a closed position with an insert removed.
Figure 7:
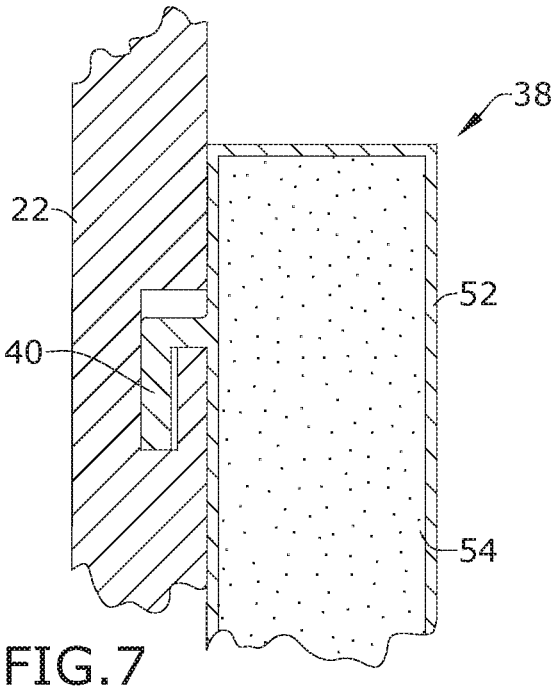
FIG. 7 is a detailed section view illustrating an ice stick connection point.
Figure 8:
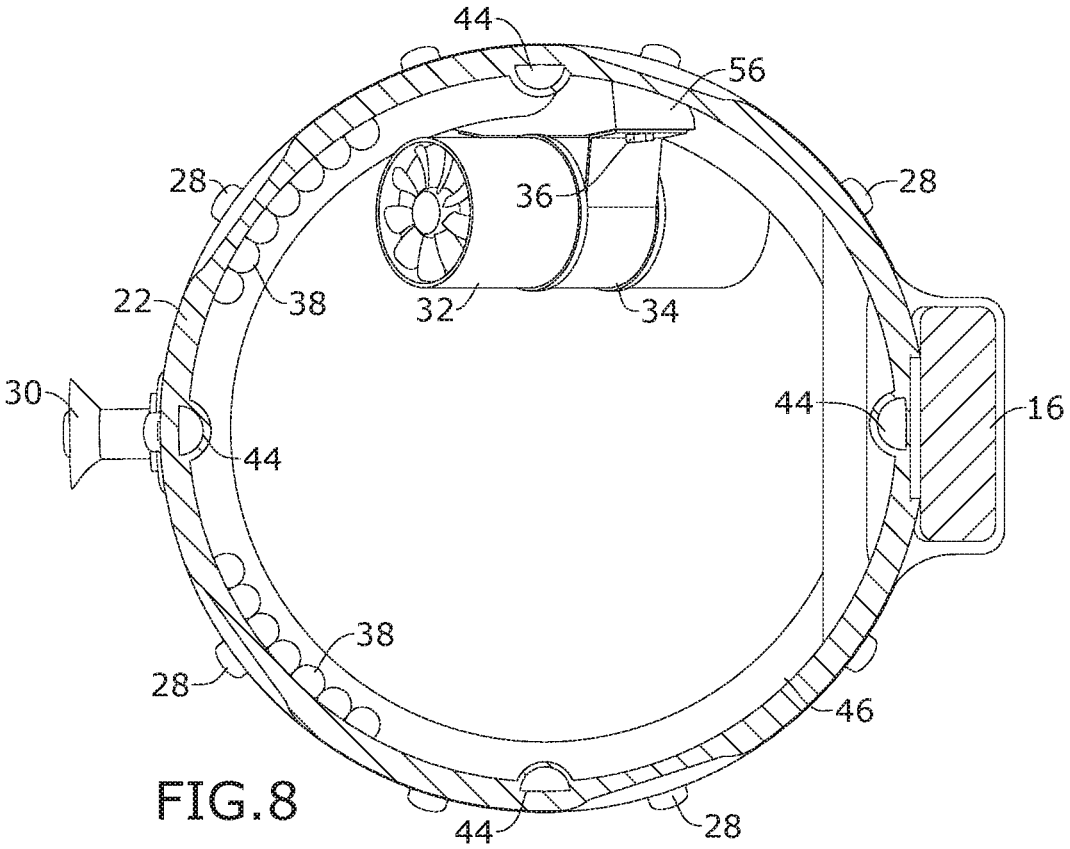
FIG. 8 is a section view of an embodiment of the present invention, taken along line 8-8 in FIG. 4.

Referring to FIGS. 1 through 8, the present invention includes a cooler. The cooler includes a body 22 made of an insulating material. The body 22 includes a base and a sidewall upstanding from the base. The sidewall includes an upper rim defining an opening into the body 22. A spring 58 biased spigot 30 may be coupled to a bottom of the sidewall. A lid 10 releasably couples to the upper rim of the sidewall and covers the opening. A battery 16 is coupled to the body 12. A mixer 32 is coupled to an inner surface of the body 12 and includes a motor electrically coupled to the battery 16. The mixer 32 is configured to circulate water within the body when the motor is powered by the battery 16.

The battery 16 of the present invention may include a lithium ion, nickel cadmium, nickel-metal hydride, lead-acid or the like to power the components of the cooler. In certain embodiments, a battery holder 18 may be disposed on an outer surface of the sidewall. The battery holder 18 receives and contains the battery 16. Electrical wiring may run from the battery holder 18 through horizontal wire channels 46 and vertical wire channels 44 to connect to the powered components of the present invention.

The mixer 32 of the present invention may be any type of powered mixer that is capable of mixing a liquid within the cooler. The mixer 32 may include a pump capable of pumping fluid and thereby mixing the liquid. The mixer 32 may further include a rotating shaft rotated by a motor and a plurality of vanes coupled to the rotting shaft. When the mixer 32 is powered on, the rotating shaft rotates, thereby rotating the vanes and circulating the liquid within the cooler. In certain embodiments, the mixer 32 may be coupled to an inner surface of the cooler by a bracket 34 and retaining bolts 36. The bracket 34 is coupled to a motor mount 56 by the retaining bolts 36.

The cooler of the present invention may further indicate a level of liquid within the body 22. In such embodiments, the present invention may include at least one light and sensor 20, 26, 28 electrically coupled to the battery 16. A sensor portion may be disposed on an inner surface of the body 22 and a light portion may be disposed on an outer surface of the body 22. The sensor portion detects a level amount of liquid within the body 22 and the light portion provides an indication of the level amount. For example, the present invention may include a top light and sensor 20, a middle light and sensor 26, a lower light and sensor 28. The sensor portion may sense liquid. When the liquid level is at or above the top light and sensor 20, all of the light portions are on, indicating that the cooler is full. When the liquid level is below the top light and sensor 20 and at or above the middle light and sensor 26, the light portions of the middle light and sensor 26 and the lower light and sensor 28 are turned on but the light portion of the top light and sensor 20 is turned off. When the liquid level is below the middle light and sensor 26 and at or above the lower light and sensor 20, the light portion of the lower light and sensor 20 is turned on but the light portion of the middle light and sensor 26 and the top light and sensor 20 are turned off. If the liquid level is below the lower light and sensor 20, all of the light portions are turned off, indicating that the cooler needs to be refilled.

The present invention may further include speakers 14 coupled to opposing sides of the body 22. The speakers 14 are coupled to an outer surface of the sidewall and electrically coupled to the battery 16. The speakers may be seated in compartments 42 defined at the top of the sidewall. The speakers 14 may include a wireless receiver for receiving commands from a computer. For example, the speakers 14 may include BLUETOOTH™ capabilities.

The present invention may further include ice packs 38 to keep the internal temperature of the cooler lower. In certain embodiments, the ice packs 38 may include hooks 40. Slots are defined on the inner surface of the sidewall. The hooks 40 fit within the slots and are thereby releasably retained to the sidewalls. When the cooler is not in use, the ice packs 38 may be removed and placed within a freezer. When the cooler is in use, the user may secure the ice packs 38 to the sidewall of the body 22. The ice packs 38 may include an outer cased 52 and an internal frozen material 54.

The lid 10 is threadably connected to the upper rim of the sidewall. In certain embodiments, the lid 10 may further include a removeable section 12. The removeable section 12 may include a wedge or pizza slice shape. The removeable section 12 includes a male protruding lip 48 extending from a periphery. The male protruding lip 48 slidably mates with a female slot 50 of an inner rim of a main section of the lid 10. The removeable section allows use to remove only a portion of the lid 10 and pour liquid and/or powder into the cooler.

It should be understood, of course, that the foregoing relates to exemplary embodiments of the invention and that modifications may be made without departing from the spirit and scope of the invention as set forth in the following claims.

What is claimed is:

1. A cooler that dispenses liquid comprising:

a one compartment body made of an insulating material and comprising a base and a sidewall upstanding from the base, wherein the sidewall comprises an upper rim defining an opening into the body;

a spring biased spigot coupled to a bottom of the sidewall and in liquid communication with an interior of the body;

a lid releasably coupled to the upper rim of the sidewall and covering the opening;

a battery;

at least one sensor and at least two lights electrically coupled to the battery and sensor, the at least two lights disposed on an outer surface of the sidewall at distinct fill levels of the body, wherein the sensor detects a level amount of liquid within the body and the at least two lights provide an indication of the fill level at the outer surface of the sidewall based on which of the at least two lights are illuminated at the sidewall, whereby a lighting level indication geometrically coincides with the fill level within the cooler;

and a mixer coupled to an inner surface of the body and comprising a motor electrically coupled to the battery, wherein the mixer is configured to circulate water within the body when the motor is powered by the battery.

2. The cooler of claim 1, wherein the mixer is a pump.

3. The cooler of claim 1, wherein the mixer comprises a rotating shaft rotated by the motor, and a plurality of vanes coupled to the rotating shaft.

4. The cooler of claim 1, further comprising a speaker coupled to an outer surface of the sidewall and electrically coupled to the battery, wherein the speaker comprises a wireless receiver for receiving commands from a computer.

5. The cooler of claim 1, further comprising at least one ice pack comprising a hook, wherein an inner surface of the sidewall comprises a slot sized to receive and retain the hook therein.

6. The cooler of claim 1, wherein the lid is threadably connected to the upper rim of the sidewall.

7. The cooler of claim 6, wherein the lid further comprises a removeable section.

8. The cooler of claim 7, wherein the removeable section comprises a wedge shape.

9. The cooler of claim 8, wherein the removeable section comprises a male protruding lip that slidably mates with a female slot of a main section of the lid.

* * * * *